US008529363B1

(12) United States Patent
Grafe

(10) Patent No.: US 8,529,363 B1
(45) Date of Patent: Sep. 10, 2013

(54) SELF-ATTACHING GOLF PUTTER AID

(76) Inventor: Thomas Grafe, Gnadenhutten, OH (US)

( * ) Notice: Subject to any disclaimer, the term of this patent is extended or adjusted under 35 U.S.C. 154(b) by 381 days.

(21) Appl. No.: 12/955,955

(22) Filed: Nov. 30, 2010

(51) Int. Cl.
*A63B 69/36* (2006.01)
*A63B 53/16* (2006.01)

(52) U.S. Cl.
USPC ..... 473/206; 473/226; 473/293; 473/294; 473/295; 473/298

(58) Field of Classification Search
USPC ..... 473/219, 206, 226, 239, 298, 232, 473/293, 294, 295
See application file for complete search history.

(56) References Cited

U.S. PATENT DOCUMENTS

| | | | | |
|---|---|---|---|---|
| 3,533,630 | A | 10/1970 | Monaco | |
| 5,088,738 | A | 2/1992 | Mundt et al. | |
| 5,188,361 | A | 2/1993 | Coombe | |
| 5,277,427 | A * | 1/1994 | Bryan et al. | 473/232 |
| D363,966 | S | 11/1995 | Juiliano | |
| 5,649,870 | A * | 7/1997 | Harrison | 473/239 |
| 5,746,662 | A * | 5/1998 | Squire | 473/206 |
| 5,997,412 | A * | 12/1999 | Benson | 473/296 |
| 6,196,930 | B1 * | 3/2001 | Aumock | 473/206 |
| 6,656,056 | B1 | 12/2003 | Leonard | |
| 7,160,199 | B1 | 1/2007 | Mitchell et al. | |
| 7,510,482 | B2 * | 3/2009 | Benson | 473/296 |
| 7,789,765 | B2 * | 9/2010 | Marini | 473/226 |
| 2003/0207723 | A1 * | 11/2003 | Jacoby | 473/298 |
| 2004/0023728 | A1 * | 2/2004 | Drossos | 473/287 |

* cited by examiner

*Primary Examiner* — Sebastiano Passaniti
(74) *Attorney, Agent, or Firm* — Kyle Fletcher

(57) ABSTRACT

The self-attaching golf putter aid includes an upper grip joined at a pivot point with a bottom bracket such that the upper grip can rotate about a vertical axis with the bottom bracket. The bottom bracket is designed to attach onto the handle of a putter via an adjustable strap. The aid is used by grabbing the upper grip with a first hand while grabbing the bottom bracket and handle of the putter with a second hand, and wherein the end user holds the upper grip stationary while swinging the putter to form a true and smooth pendulum golf putting stroke that is ideal when putting.

12 Claims, 3 Drawing Sheets

SELF-ATTACHING GOLF PUTTER AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of golf training devices, more specifically, an accessory that attaches onto the handle of a putter for use in practicing a smooth pendulum for a putting stroke.

Maintaining a true pendulum putting stroke is very important while on the putting green. A true pendulum will prevent a golfer from "pushing" the golf ball to either side of the hole.

B. Discussion of the Prior Art

As a preliminary note, it should be stated that there is an ample amount of prior art that deals with putter teaching aids. As will be discussed immediately below, no prior art discloses an apparatus that attaches itself onto the handle of a putter and of which aids in teaching a smooth pendulum putter swing; pivot point with respect to a bottom bracket; wherein the bottom bracket is responsible for securement of the accessory to the handle of the putter; wherein the pivot point enables the upper grip to rotate along a vertical plane, which aids in teaching a smooth pendulum used in a putter stroke; wherein an end user grabs the upper grip with a first hand while holding the putter handle in a second hand, and said end user performs a smooth pendulum stroke with said putter.

The Mundt et al. Patent (U.S. Pat. No. 5,088,738) discloses an attachment for the hand of a human which is a freely, pivotally mounted handle located on a shaft extending from an elongated clamping member that is longitudinally movable to clamp the grip of the putter within a housing in which the grip is received. However, the attachment does not teach the use of an upper grip that is aligned above a bottom bracket and putter such that an end user holds a first hand upon the upper grip and a second hand upon the putter and bottom bracket in order to conduct a smooth pendulum with the putter.

The Monaco Patent (U.S. Pat. No. 3,533,630) discloses a device for controlling and stabilizing the gripping of a golf club comprising a handle that is clamped to the contentional grip of the golf club shaft. However, the device does not teach an accessory that attaches onto a putter handle and of which includes an upper grip that pivots about the putter to teach a pendulum stroke.

The Coombe Patent (U.S. Pat. No. 5,188,361) discloses a golf putter with an extension handle receiving an upper distal end of an associated golf putter. However, the golf putter includes the pivoting upper handle, and is not accessory that attaches, onto and disconnects from the handle of an existing putter.

The Mitchell et al. Patent (U.S. Pat. No. 7,160,199) discloses a golf training device comprising an attachment socket for attaching the device on top of a hand grip of a golf club. Again, the device does not teach the use of an upper grip that is aligned above a bottom bracket and putter such that an end user holds a first hand upon the upper grip and a second hand upon the putter and bottom bracket in order to conduct a smooth pendulum with the putter.

The Leonard Patent (U.S. Pat. No. 6,656,056) discloses a device having a sleeve for attaching onto the golf club for training a golfer to swing a golf club using his/her shoulders rather than wrists. However, the device is directed to locking a wrist of an end user and not to teaching a true pendulum putting stroke of which an accessory attaches onto a handle of a putter.

The Juliano Patent (U.S. Pat. No. Des. 363,966) illustrates a design of a golf aid for putting practice, which does not depict an accessory that attaches onto a handle of a putter.

While the above-described devices fulfill their respective and particular objects and requirements, they do not describe an apparatus that attaches itself onto the handle of a putter and of which aids in teaching a smooth pendulum putter swing; wherein the accessory includes an upper grip that pivots about a pivot point with respect to a bottom bracket; wherein the bottom bracket is responsible for securement of the accessory to the handle of the putter; wherein the pivot point enables the upper grip to rotate along a vertical plane, which aids in teaching a smooth pendulum used in a putter stroke; wherein an end user grabs the upper grip with a first hand while holding the putter handle in a second hand, and said end user performs a smooth pendulum stroke with said putter. In this regard, the self-attaching golf putter aid departs from the conventional concepts and designs of the prior art.

SUMMARY OF THE INVENTION

The self-attaching golf putter aid includes an upper grip joined at a pivot point with a bottom bracket such that the upper grip can rotate about a vertical axis with the bottom bracket. The bottom bracket is designed to attach onto the handle of a putter via an adjustable strap. The aid is used by grabbing the upper grip with a first hand while grabbing the bottom bracket and handle of the putter with a second hand, and wherein the end user holds the upper grip stationary while swinging the putter to form a true and smooth pendulum golf putting stroke that is ideal when putting.

An object of the invention is to provide a putting aid that attaches onto the handle of a putter and teaches and/or aids an end user in swinging the putter in a smooth pendulum, which is ideal when putting.

A further object of the invention is to provide an aid that attaches onto an existing putter and of which can be easily removed.

A further object of the invention is to provide an aid that requires an end user to support an upper grip stationary while swinging a putter with an opposing hand.

These together with additional objects, features and advantages of the self-attaching golf putter aid will be readily apparent to those of ordinary skill in the art upon reading the following detailed description of presently preferred, but nonetheless illustrative, embodiments of the self-attaching golf putter aid when taken in conjunction with the accompanying drawings.

In this respect, before explaining the current embodiments of the self-attaching golf putter aid in detail, it is to be understood that the self-attaching golf putter aid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self-attaching golf putter aid.

It is therefore important that the claims be regarded as including such equivalent construction insofar as they do not depart from the spirit and scope of the self-attaching golf putter aid. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
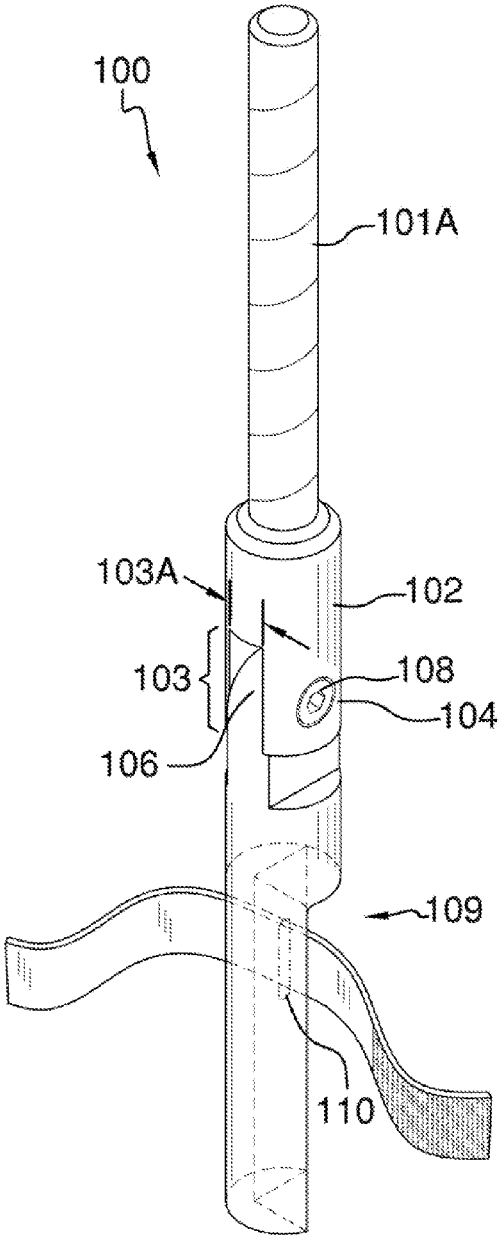
FIG. 1 illustrates a front, isometric view of the self-attaching golf putter aid by itself and with the strap unwrapped and with dashed lines indicating the cutout of the accessory.
Figure 2:
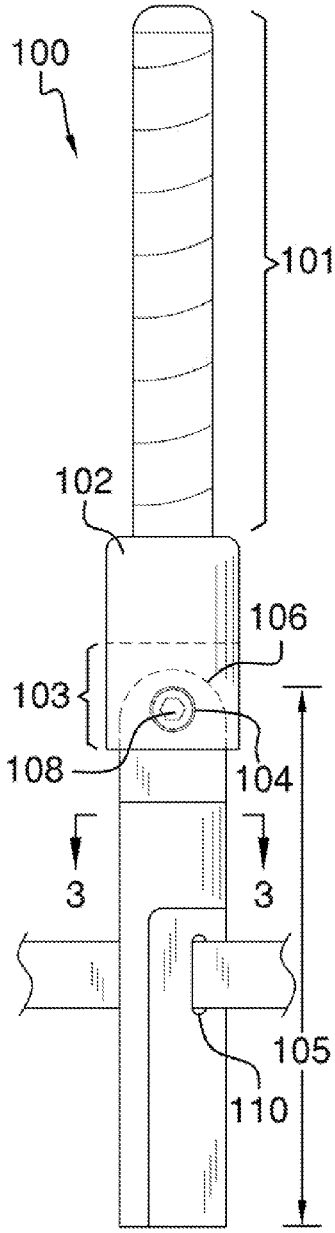
FIG. 2 illustrates a front view of the self-attaching golf putter aid by itself and with dashed lines indicating the recess formed between the upper grip and the base bracket that enable the pivot point to pivot.
Figure 3:
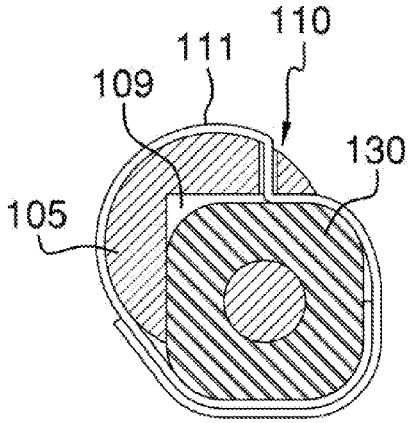
FIG. 3 illustrates a cross-sectional view of the self-attaching golf putter aid along line 3-3 in FIG. 2 and detailing the self-attaching golf putter aid in use with a putter handle and depicting where the cutout of the base bracket supports the putter handle, and further defining the strap wrapped around both the putter handle and the base bracket.
Figure 4:
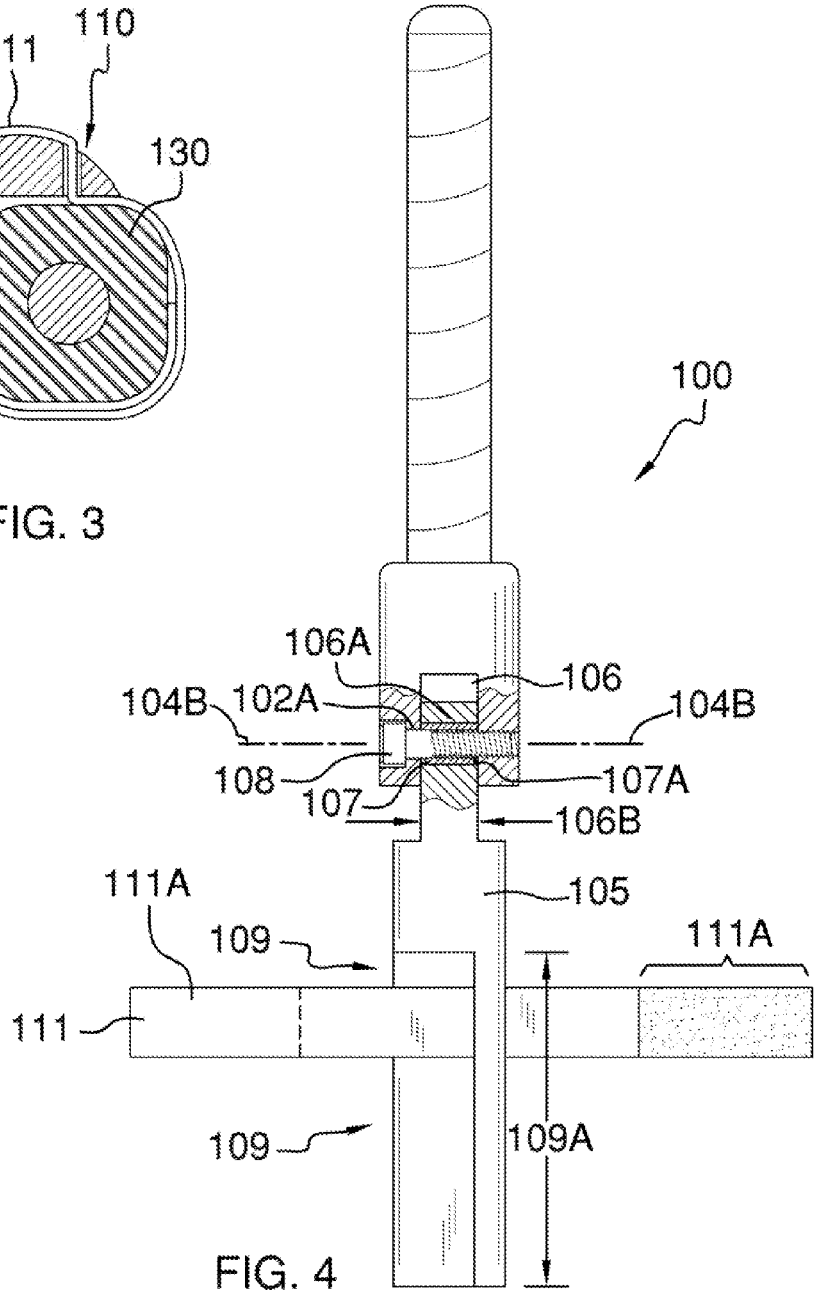
FIG. 4 illustrates a side view of the self-attaching golf putter aid with a cut-away detail that depicts the cap screw and brushing that form the pivot point between the upper handle and the lower bracket.
Figure 5:
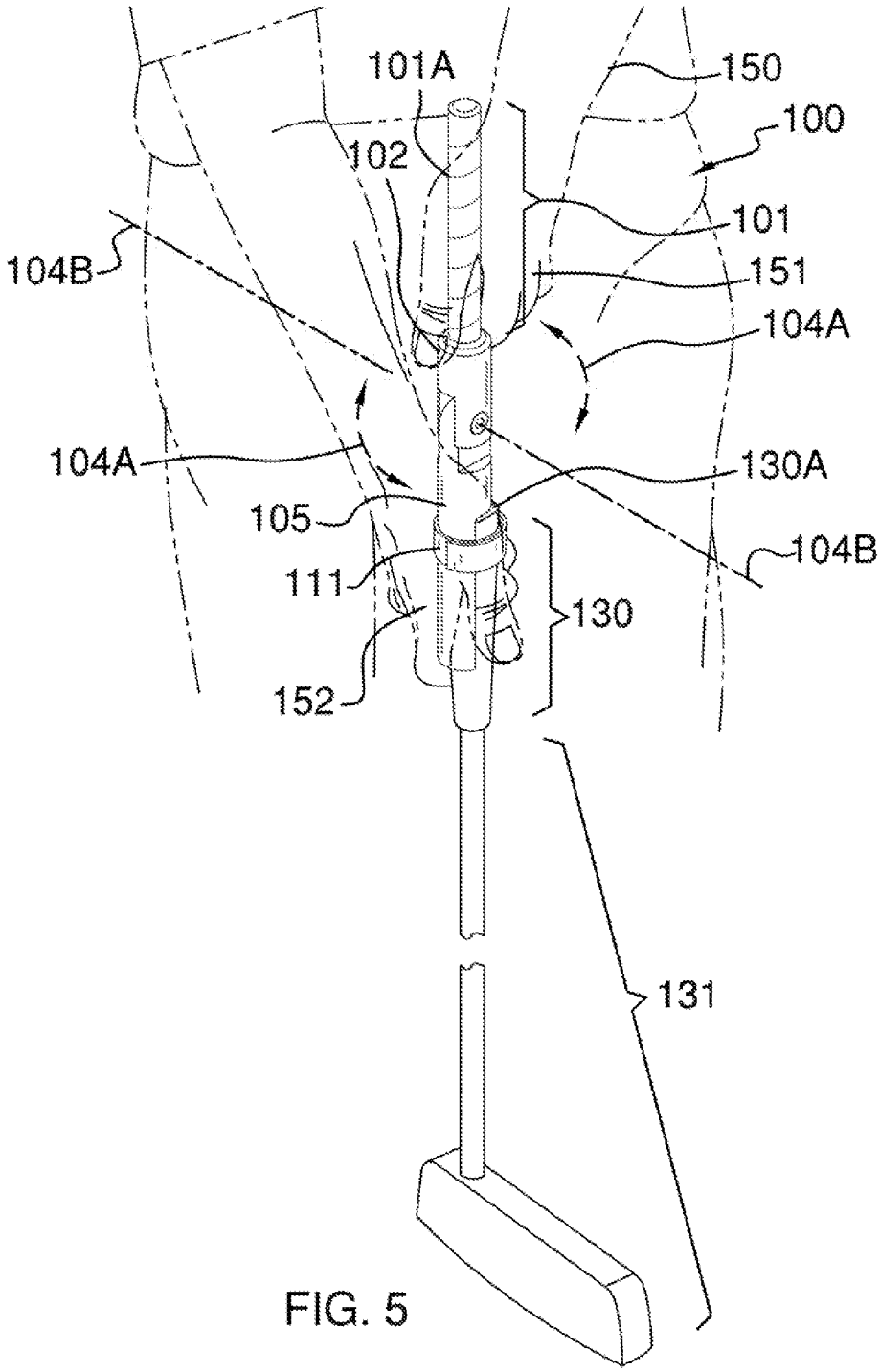
FIG. 5 illustrates an isometric view of the self-attaching golf putter aid attached onto a putter.

Detailed reference will now be made to the preferred embodiment of the present invention, examples of which are illustrated in FIGS. 1-5. A self-attaching golf putter aid 100 (hereinafter invention) includes an upper grip 101 that is defined by a base 102 upon which the upper grip 101 extends. The base 102 has a notch 103 that is removed in order to accommodate a pivot point 104.

A bottom bracket 105 connects to the base 102 at the pivot point 104. The bottom bracket 105 includes a semi-circular end 106 that is fitted in between the notch 103 of the base 102 (see FIG. 4). The semi-circular end 106 has a hole 106A through which a bushing 107 is seated. The semi-circular end 106 has a thickness 106B that is less than a width of the notch 103A. The bushing 107 has a hole 107A that accommodates a bolt 108.

The base 102 has a shoulder 102A that a head of the bolt 108 rests up against when forming the pivot point 104. The bolt 108 travels across the base 102, the hole 106A' of the semi-circular end 106, and the width of the bushing 107. The bushing 107 is responsible for insuring the pivot point 104 operates smoothly in that the upper grip 101 can rotate with respect to the bottom bracket 105, and vice versa. The rotation of the pivot point 104 is depicted with rotating arrows 104A (see FIG. 5), which indicates the rotation of the upper grip 101 with respect to the bottom bracket 105. The pivot point 104 rotates about a horizontal axis 104B relative to the invention 100.

The bottom bracket 105 extends downwardly from the pivot point 104, and includes a recess 109. The recess 109 is in the shape of a right angle and is defined by a distance 109A. The recess 109 is designed to engage upon a top end 130A of a putter handle 130. The bottom bracket 105 also includes a slot 110 through which a strap 111 passes. The strap 111 is a flexible material of an undefined length that includes self-securing means 111A thereon. The self-securing means 111A, will generally include a nylon hook and loop strip, enables the strap 111 to wrap around an object (the putter handle 130) and secure the strap 111 thereon.

The upper grip 101 may be outfitted with a leather strap or other golf grip 101A that is customarily used with a golf putter 131.

The invention 100 is used when an end user 150 grabs the upper grip 101 with a first hand 151, and a second hand 152 grabs the putter handle 130 and the bottom bracket 105 together. Next, the end user 150 will hold the first hand 151 an the upper grip 101 stationary while rotating the putter handle 130 and the bottom bracket 105 along a path of a pendulum formed by the pivot point 104.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A golf putter aid comprising:

an upper grip that attaches to a bottom bracket via a pivot point;

wherein the bottom bracket is configured to attach onto an upper end of a putter handle of a putter;

wherein an end user holds the upper grip stationary with a first hand and is capable of rotating both the bottom bracket and the putter handle via a second hand, and thus forms a pendulum along which the putter travels;

wherein the upper grip includes a base that extends below said upper grip; wherein the base has a notch into which a semi-circular end of the bottom bracket intersects to form the pivot point;

wherein the semi-circular end is further defined by a hole into which a bushing is seated and of which a bolt passes across the base of the notch to secure the semi-circular end of the bottom bracket thereon;

wherein the semi-circular end has a thickness that is less than a width of the notch;

wherein the base has a shoulder that a head of the bolt rests up against when forming the pivot point.

2. The golf putter aid as described in claim 1 wherein the pivot point provides independent rotational movement of the bottom bracket relative to the upper grip along a horizontal axis said horizontal axis being perpendicular with respect to the longitudinal alignment of the upper grip and bottom bracket.

3. The golf putter aid as described in claim 1 wherein the upper grip has a leather strap or golf grip thereon.

4. The golf putter aid as described in claim 1 wherein the bottom bracket has a recess formed along a length that is a right angle, and is used to secure the upper end of the putter handle therein.

5. The golf putter aid as described in claim 4 wherein a slot is included on the bottom bracket for a strap to pass there through; wherein the strap includes a nylon hook and loop strip integrated thereon such that the strap can wrap around the putter handle and secure the putter handle within the recess of the bottom bracket.

6. A golf putter aid comprising:

an upper grip that attaches to a bottom bracket via a pivot point;

wherein the bottom bracket is configured to attach onto an upper end of a putter handle of a putter;

wherein the bottom bracket extends downwardly from the pivot point;

wherein an end user holds the upper grip stationary with a first hand and is capable of rotating both the bottom bracket and the putter handle via a second hand, and thus forms a pendulum along which the putter travels;

wherein the upper grip includes a base that extends below said upper grip; wherein the base has a notch into which a semi-circular end of the bottom bracket intersects to form the pivot point;

wherein the semi-circular end is further defined by a hole into which a bushing is seated and of which a bolt passes across the base of the notch to secure the semi-circular end of the bottom bracket thereon;

wherein the bottom bracket has a recess formed along a length that is a right angle, and is used to secure the upper end of the putter handle therein;

wherein a slot is included on the bottom bracket for a strap to pass there through; wherein the strap has a nylon hook and loop strip integrated thereon such that the strap can wrap around the putter handle and secure the putter handle within the recess of the bottom bracket.

7. The golf putter aid as described in claim 6 wherein the semi-circular end has a thickness that is less than a width of the notch; and wherein the base has a shoulder that a head of the bolt rests up against when forming the pivot point; wherein the pivot point provides independent rotational movement of the bottom bracket relative to the upper grip along a horizontal axis said horizontal axis being perpendicular with respect to the longitudinal alignment of the upper grip and bottom bracket.

8. The golf putter aid as described in claim 6 wherein the upper grip has a leather strap or golf grip thereon.

9. A golf putter aid comprising:

an upper grip that attaches to a bottom bracket via a pivot point;

wherein the bottom bracket is configured to attach onto an upper end of a putter handle of a putter;

wherein the upper grip includes a base that extends below said upper grip;

wherein an end user holds the upper grip stationary with a first hand and is capable of rotating both the bottom bracket and the putter handle via a second hand, and thus forms a pendulum along which the putter travels;

wherein the pivot point provides independent rotational movement of the bottom bracket relative to the upper grip along a horizontal axis said horizontal axis being perpendicular with respect to the longitudinal alignment of the upper grip and bottom bracket;

wherein the bottom bracket has a recess formed along a length that is a right angle, and is used to secure the upper end of the putter handle therein;

wherein a slot is included on the bottom bracket for a strap to pass there through; wherein the strap has a nylon hook and loop strip integrated thereon such that the strap can wrap around the putter handle and secure the putter handle within the recess of the bottom bracket.

10. The golf putter aid as described in claim 9 wherein the upper grip includes a base that extends below said upper grip; wherein the base has a notch into which a semi-circular end of the bottom bracket intersects to form the pivot point; wherein the semi-circular end is further defined by a hole into which a bushing is seated and of which a bolt passes across the base of the notch to secure the semi-circular end of the bottom bracket thereon; wherein the base has a shoulder that a head of the bolt rests up against when forming the pivot point.

11. The golf putter aid as described in claim 10 wherein the semi-circular end has a thickness that is less than a width of the notch.

12. The golf putter aid as described in claim 9 wherein the upper grip has a leather strap or golf grip thereon.

* * * * *